United States Patent [19]

Gunnergaard

[11] 3,965,966

[45] June 29, 1976

[54] APPARATUS FOR THE PRODUCTION OF CASTINGS

[75] Inventor: Marius Gunnergaard, Lyngby, Denmark

[73] Assignee: Dansk Industri Syndikat A/S, Herlev, Denmark

[22] Filed: Aug. 27, 1975

[21] Appl. No.: 608,334

[30] Foreign Application Priority Data

Sept. 11, 1974 Denmark ..... 4796/74

[52] U.S. Cl. ..... 164/213; 198/184; 198/203

[51] Int. Cl.[2] ..... B22C 11/08

[58] Field of Search ..... 164/180, 323, 213, 187; 198/184, 203

[56] References Cited

UNITED STATES PATENTS 3,688,894 9/1972 Joug et al. ..... 198/184

3,717,241 2/1973 Arieh ..... 198/184

3,749,151 7/1973 George et al. ..... 164/187 X

*Primary Examiner*—Willie G. Abercrombie

*Assistant Examiner*—Horace M. Culver

*Attorney, Agent, or Firm*—Imirie, Smiley & Linn

[57] ABSTRACT

In a casting apparatus using a mould which comprises a horizontal series of identical mould parts and presents at least one casting cavity at each joint between successive mould parts, the mould is advanced stepwise on a guideway including a driving section having a reciprocating support plate with apertures to periodically supply compressed air to reduce the friction between the plate and the mould sufficiently to neutralize the driving effect of the plate.

4 Claims, 2 Drawing Figures

APPARATUS FOR THE PRODUCTION OF CASTINGS

Figure 1:
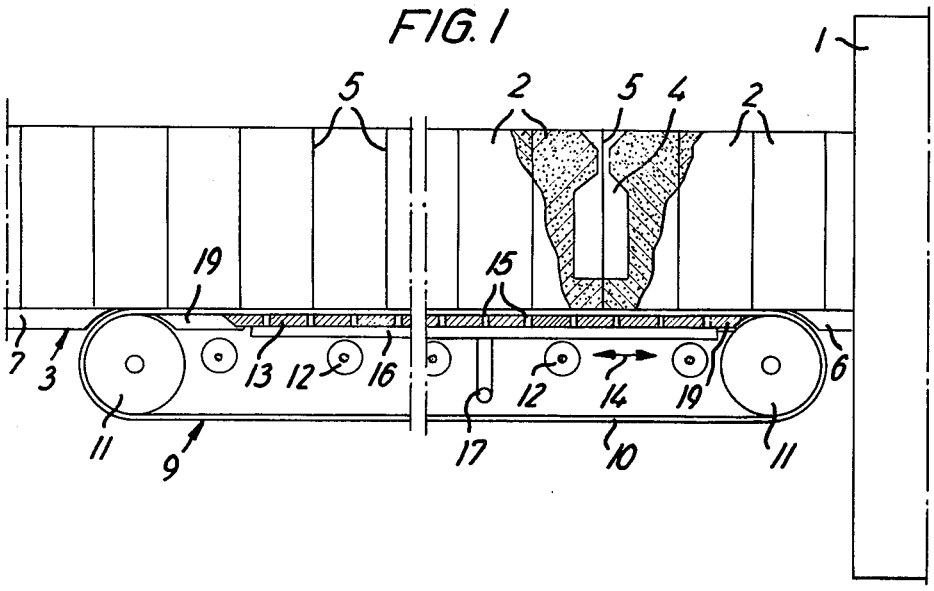

The invention relates to an apparatus intended for the production of castings, comprising a device for the successive production of identical mould parts and a pouring track or guideway on which the mould parts are stacked together for the formation of a casting mould having at least one pouring cavity at each joint, said guideway over at least part of its length including a driving element which is reciprocable in the longitudinal direction of the guideway and solely during its forward stroke or part of this stroke is in driving connection with the casting mould.

The reciprocating driving element contributes to the stepwise advance of the casting mould from the mould part producing device via a pouring station and a cooling region to a knocking-out station. During this operation it is of the greatest importance that any movement between the successive mould parts is precluded, at any rate until the material poured in has solidified, since even a minimum lateral or vertical displacement between two mould parts or a slight opening of the joint between the parts will in many cases result in discardable castings.

In prior art equipment of the type mentioned above the reciprocating driving element consists of lateral rails or grate bars which during their forward stroke are held in driving engagement with the casting mould for carrying along the latter and which during the return stroke are removed or eased so much from the casting mould that the latter remains stationary on its support. When grate bars are used, they may form part of a travelling gate, the remaining grate bars of which form the support for the casting mould when stationary.

In these prior art constructions, a rather complicated movement of the lateral rails or grate bars is required in order to properly time the engagement with and the disengagement from the casting mould, and at any rate in the case of lateral rails great frictional forces between the casting mould and its support have to be overcome during every step of advance. When using a travelling grate, the friction may be avoided by the grate bars serving as a non-advancing support being raised and lowered substantially in counter-phase to the grate bars serving as driving element, but this additionally complicates the design and control of the apparatus.

The apparatus according to the invention differs from the prior art constructions in that the driving element is a plate which is reciprocable in its own plane and presents a number of apertures, through which compressed air can periodically be supplied to the top of the plate for eliminating the driving connection between the plate and the casting mould.

When no compressed air is supplied to the apertures of the plate, the casting mould will rest stationary on the plate and follow the movement of the latter without any possibility of a displacement between the individual mould parts, but when compressed air is supplied, a kind of air cushion or air film is formed between the plate and the casting mould to reduce the friction sufficiently to make possible a movement of the plate without the casting mould being carried along. Such a reduction of the friction does not necessitate any measurable raising of the casting mould, and the individual mould parts consequently have no possibility of changing their position in relation to each other.

An additional advantage is that between the periods of compressed-air supply the casting mould is in intimate, heat-conducting connection with the apertured plate, and that the compressed air can contribute to cooling this plate as well as the mould, thus making possible a shortening of the time for cooling down the castings.

In a preferred embodiment of the apparatus according to the invention the apertured plate is mounted directly under a flexible belt which is in firm frictional engagement with the plate during at least part of the forwarddirected movement thereof and is so arranged that when compressed air is supplied through the apertures in the plate the belt is eased so much that it is not carried along with the plate during its return movement. In this case, the friction-reducing air film is thus produced between the plate and the belt, but apart from this, the function and effect are the same as explained above. The belt protects the casting mould from the direct blowing action of the compressed air and contributes to the uniform distribution of the air over the entire surface of the plate.

Figure 2:
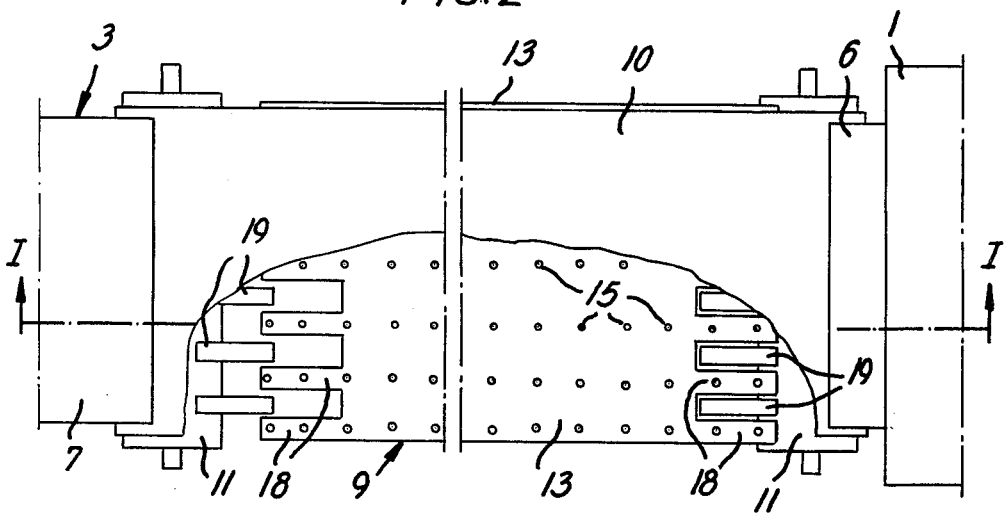

The invention will now be more fully explained with reference to the accompanying drawing in which FIG. 1 shows a diagrammatical side elevation, partly in section on line I—I in FIG. 2 and with certain parts omitted, of an embodiment of the apparatus according to the invention with a casting mould being produced, and FIG. 2 a corresponding plan view without the casting mould and with parts of the conveyor belt cut away.

The apparatus includes a device 1 for the successive production of identical mould parts 2 from sand or similar material that is compressed between a pair of vertical pattern plates. Such a device is known per se and is therefore neither described nor illustrated in detail. In timed relationship with the production, the mould parts 2 are ejected onto a guideway or pouring track 3, on which they are stacked closely together in a row with one or more pouring cavities 4 at each joint 5 in the casting mould thus formed. The pouring of the metal can be performed manually or by means of an automatically functioning apparatus which forms no part of the invention and therefore is not shown in the drawing.

The guideway or pouring track 3 includes a fixed bottom plate 6 extending from the device 1 and a conveyor 7 of any suitable type leading to a knocking-out station, not shown, as well as an intermediate carrying and advancing section 9. In the embodiment shown, the conveyor 7 simply comprises a sliding track for the casting mould but it could also be a belt or travelling grate type conveyor. The intermediate section 9 is shown as an endless, flexible conveyor belt 10 running over a pair of idler rollers 11 at a slight distance from the bottom plate 6 and the sliding track 7 which are flush with the upper run of the belt. Below this upper run a plurality of idler rollers 12 are mounted to support a plate 13, the length of which is somewhat shorter than the distance between the axes of the rollers 11 and which is reciprocable between these rollers as indicated by the double arrow 14. This movement can be brought about in a way either mechanically, hydraulically, pneumatically or electrically or by a combination thereof.

The plate 13 is provided with numerous apertures 15 which terminate in the top of the plate and are in communication with a distribution chamber 16 connected to the bottom of the plate and having a pipe connection 17 through which compressed air can be supplied periodically.

The stroke of the reciprocating movement of the plate 13 may be adjustable and should in most cases be equal to at least the thickness or axial length of the mould parts 2.

The plate 13 is shown in its right-hand extreme position, in which its right-hand end is located at only a slight distance from the adjacent roller 11. This plate end is shaped like a comb with fingers 18, the length of which is slightly longer than the maximum stroke of the plate and which engage between stationary fingers 19. A similar comb arrangement with plate fingers 18 and stationary fingers 19 is provided at the left-hand reversing roller 11, and here it appears that the fingers 19 serve for bridging the spaces between the roller 1 and the plate 13.

With the parts in the position shown in the drawing, an additional mould part 2 is added to the casting mould, and at the same time the plate 13 is displaced to the left. During this movement the top of the conveyor belt rests firmly on the plate so that the casting mould is moved one step to the left. After this movement has been terminated, compressed air is supplied to the chamber 16, so that the plate 13 can be displaced back into its starting position without carrying the belt 10 and the casting mould along with it. If it be desired, the conveyor belt may in this situation be secured positively by means of a releasable locking mechanism, not shown. After the return stroke has been terminated, the supply of compressed air is discontinued, and the guideway section 9 is now ready for the next operation.

The effective length of the advance of the mould in each step may, as mentioned above, be adjusted by an adjustment of the stroke of the plate 13. Another possibility is to let the plate have a fixed stroke and to control the supply of compressed air in such a way that the driving frictional connection between the plate and the conveyor belt is eliminated when the mould has been displaced the distance desired, after which the plate idles during the remaining part of the advance stroke and during the entire return stroke.

Under certain circumstances the conveyor belt 10 may be omitted or substituted by a band or sheet material, for example a thin plastics sheet, which from a supply roll enters the plate 13 at the receiving end of the latter and is pulled off at the other end or possibly runs with the casting mould right up to the knocking-out station.

What is claimed is:

1. An apparatus for the production of castings, comprising a device for the successive production of identical mould parts and of a pouring track or guideway on which the mould parts are stacked together for the formation of a casting mould having at least one pouring cavity at each joint, said guideway over at least part of its length including a driving element which is reciprocable in the longitudinal direction of the guideway and solely during its forward stroke or part of this stroke is in driving connection with the casting mould, wherein the driving element is a plate which is reciprocable in its own plane and presents a number of apertures, through which compressed air can periodically be supplied to the top of the plate for eliminating the driving connection between the plate and the casting mould.

2. An apparatus as claimed in claim 1, wherein the apertured plate is mounted directly below a flexible belt which is in firm frictional engagement with the plate during at least part of the forward-directed movement thereof and is so arranged that when compressed air is supplied through the apertures in the plate, the belt is eased so much that it is not carried along with the plate during its return movement.

3. An apparatus as claimed in claim 2, wherein the conveyor is endless and is carried over idler rollers, the spacing between which is not essentially larger than necessary to make room for the reciprocable plate.

4. An apparatus as claimed in claim 3, wherein at each end the reciprocating plate is designed like a comb with fingers, the length of which is longer than the length of travel of the plate and which engage between stationary fingers for supporting the belt between the end of the plate and the adjacent roller.

* * * * *